US007347281B2

(12) United States Patent
Zastresek

(10) Patent No.: US 7,347,281 B2
(45) Date of Patent: Mar. 25, 2008

(54) CORING TUBULAR AND METHOD FOR REDUCING CONTAMINATION AND PROCESSING SPEED OF A CORE SAMPLE

(75) Inventor: Jiri Zastresek, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 184 days.

(21) Appl. No.: 11/204,919

(22) Filed: Aug. 16, 2005

(65) Prior Publication Data

US 2006/0037780 A1 Feb. 23, 2006

Related U.S. Application Data

(60) Provisional application No. 60/602,573, filed on Aug. 18, 2004.

(51) Int. Cl.
*E21B 49/02* (2006.01)

(52) U.S. Cl. ..... 175/58; 175/20; 73/864.44; 73/864.91

(58) Field of Classification Search ..... 175/20, 175/58, 249, 226, 239, 253; 403/2, 19, 309, 403/313, 344; 73/152.07, 152.11, 864.44, 73/864.91

See application file for complete search history.

(56) References Cited

U.S. PATENT DOCUMENTS 1,785,405 A * 12/1930 Candee ..... 175/249
1,857,693 A 5/1932 Quintrell
2,587,231 A 2/1952 Schierding
3,092,192 A * 6/1963 Deely ..... 175/253
3,247,315 A * 4/1966 Miller ..... 174/84 R
3,874,465 A 4/1975 Young et al.
5,209,310 A 5/1993 Clydesdale
5,439,065 A * 8/1995 Georgi ..... 175/59
6,772,651 B2 8/2004 Scott et al.

OTHER PUBLICATIONS

Half Moon Liner, http://www.corpro.co.uk/Half_Moon.htm (5 pgs.).

Thin Sleeve System (TSS), http://www.corpro.co.uk/tss.htm (5 pgs.).

* cited by examiner

*Primary Examiner*—Kenneth Thompson
(74) *Attorney, Agent, or Firm*—Cantor Colburn LLP

(57) ABSTRACT

Disclosed herein is a coring tubular. The coring tubular has a body, at least one opening hole radially oriented in the tubular body and a parting line in the tubular body. Further disclosed herein is a method for reducing contamination of a core sample. The method includes installing a coring tubular having features set forth in the foregoing paragraph in a coring tubular, running the tubular to obtain a sample and retrieving the bore by prying the tubular open at an opening hole along the parting line.

17 Claims, 2 Drawing Sheets

CORING TUBULAR AND METHOD FOR REDUCING CONTAMINATION AND PROCESSING SPEED OF A CORE SAMPLE

CROSS REFERENCE TO RELATED APPLICATIONS

This application claims the benefit of an earlier filing date from U.S. Provisional Application Ser. No. 60/602,573 filed Aug. 18, 2004, the entire disclosure of which is incorporated herein by reference.

BACKGROUND

Coring is an integral part of hydrocarbon exploration and recovery activities because it provides material from specific subterranean regions for analysis. This in turn helps the ultimate goal of hydrocarbon (or other target fluid) recovery.

Coring devices are known to the art and include a core bit, a core barrel and in many cases a barrel liner. Barrel liners help keep the core in a more pristine condition, which assists in the overall information gainable therefrom. On the negative side however once the core barrel is removed from the well to retrieve the core sample, the liners are cut either into segments of predetermined length or open (often by circular saws) along their lengths to expose the core. The act of cutting the liner open is often detrimental to core integrity and additional tends to contaminate the core with metal cuttings and cause thermal damage as well.

Since contamination reduces analytical accuracy, rendering suspect the reliability of information obtained by the analysis, present methods of coring are less than ideal.

SUMMARY

Disclosed herein is a coring tubular. The tubular has a body, at least one opening hole radially oriented in the tubular body and a parting line in the tubular body.

Further disclosed herein is a method for reducing contamination of a core sample. The method includes installing a coring tubular having features set forth in the foregoing paragraph in a coring tubular, running the core tubular to obtain a sample and exposing the core by prying the tubular open at an opening hole along the parting line.

BRIEF DESCRIPTION OF THE DRAWINGS

Referring now to the drawings wherein like elements are numbered alike in the several figures.

DETAILED DESCRIPTION

Figure 1:
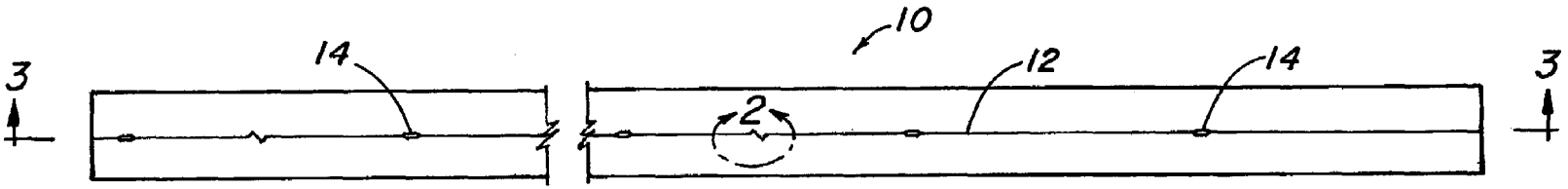
FIG. 1 is a plan view of a liner as disclosed herein illustrating parting line and axial shear arrangement.
Figure 6:
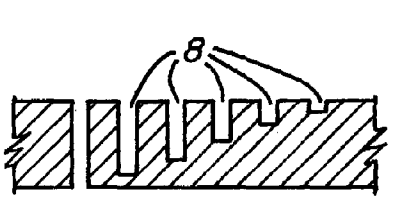
FIG. 6 is a schematic view of a cross section of the liner with perforations of varying depth.

Referring to FIG. 1, a plan view of a coring tubular, depicted as an inner barrel liner 10, is illustrated. Liner 10 includes a parting line 12 where the material of liner 10, usually metal such as aluminum or steel (or could be other materials having properties consistent with the purpose of the liner 10), is rendered easily defeatable. This can be accomplished by perforating the liner at intervals, which may be regular. The perforations 8 (see FIG. 6) may pass completely through the material thickness of the liner or may extend merely partly through the material thickness of the liner. The parting line is not intended to be cut all the way through the material thickness at all points. In order to be considered a "parting line" for purposes of this invention, there must be connection across the parting line at least in some places such that there is some structural connection across the parting line. This definition does not include adhesively backed material wrapped around a liner that is formed of two or more pieces and then "taped" together with such adhesive backed material. The perforation may be of any geometric shape such as circular, rectangular, etc. and may be such as to account for more space than the material of the liner left in place (i.e. merely tabs of the liner are left after perforation). The easily defeatable nature of parting line 12 can also be created by causing the material of liner 10 to be thinner at the location of the parting line. Yet another means by which the desired property of the parting line can be accomplished is through the use of alternate materials at the line or alternate composition or structure of the same material at the parting line. The overriding requirement is that the parting line 12 be easily defeatable thereby rendering the liner 10 easily openable without resort to machines, which might otherwise contaminate the sample core contained within the liner 10 (at the time the liner is to be opened by introduction of contaminants or heat from the rapidly moving blade).

Figure 3:
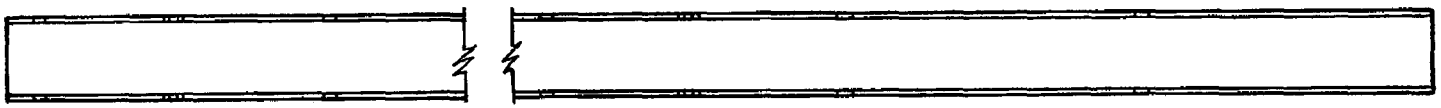
FIG. 3 is a plan view of ½ of the liner of FIG. 1 and taken along line 3-3.

In addition to the parting line, one embodiment hereof provides one or more opening holes 14. Opening holes 14 are in one embodiment sized for easily available hand tools such as a screwdriver, small pry bar etc. In the illustrated embodiment, (for a screw driver) the length and width of the opening holes 14 are sufficient to easily allow insertion of the screw driver therein but small enough to allow the screw driver to lever the liner apart along the parting line 12 with a twisting motion of the screwdriver. Proportional dimensions would be employed if it is intended that a crow bar be used to pry the liner open. Opening holes 14 are provided during the manufacturing process and therefore the sizes thereof are fixed. In one embodiment, (not specifically shown) several different sizes of holes 14 are provided for ease of opening along the parting line with whatever tool is handy to the final user. In the illustrated embodiment several opening holes 14 are provided along parting line 14 to allow sequential "popping" open of the parting line or to allow several people to pry the liner open at the same time. The opened liner 10 is visible in FIG. 3.

Figure 2:
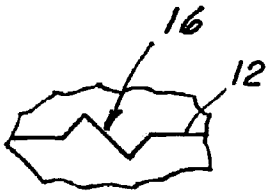
FIG. 2 is an enlarged view of circumscribed portion 2 of FIG. 1.

Referring now to FIG. 2, one element of parting line 12 in one embodiment is illustrated in enlarged form. This element is a shear arrangement 16. It is to be understood that the liner could be constructed without the shear arrangement 16 even though the liner of FIG. 1 does include the arrangement 16. The purpose of arrangement 16 is to prevent one half (or other percentage portion of the liner) of the liner 10 from moving axially relative to the other half (or other percentage portion of the liner) of liner 10 during the core capturing operation or core withdrawal operation. In the embodiment of FIG. 2, a zig zag pattern of parting line 12 is provided for just this result. While many different angles of the zig zag pattern (including simple repeating angular patterns, alternating or otherwise changing angular patterns where changes occur in either frequency or amplitude or both or even square toothed patterns for example) are employable with greater axial retention being provided by larger angles measured from the straight portion of the parting line, it has been found that about 45° is easily created and functions as intended. Shear arrangement 16 is in normal operation of liner 10 not used as the liner 10 is not easily susceptible to shear when the parting line is intact. In the event that parting line 12 is parted prematurely, shear movement of the liner can become detrimental to core integrity. It is in this situation that the shear arrangement 16 is put into service and is instrumental in avoiding problems with the core sample.

Figure 4:
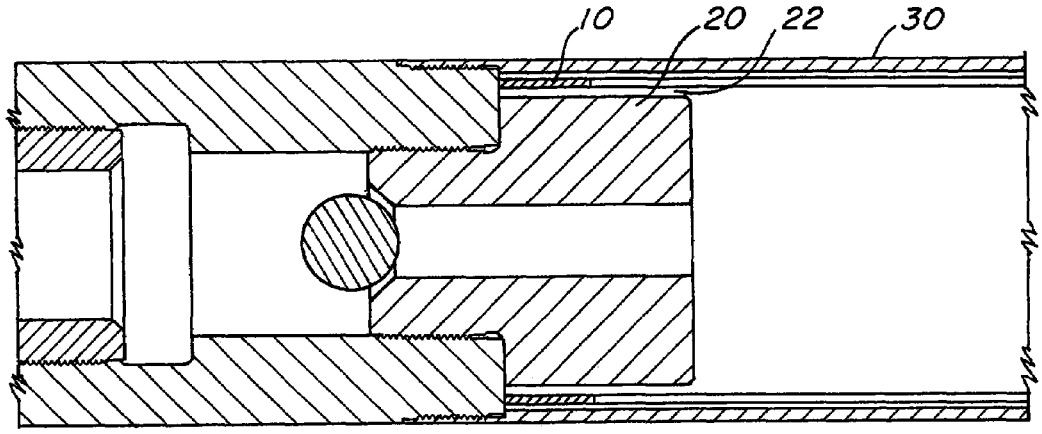
FIG. 4 is a schematic view of an uphole end of the liner with assembled support structures.
Figure 5:
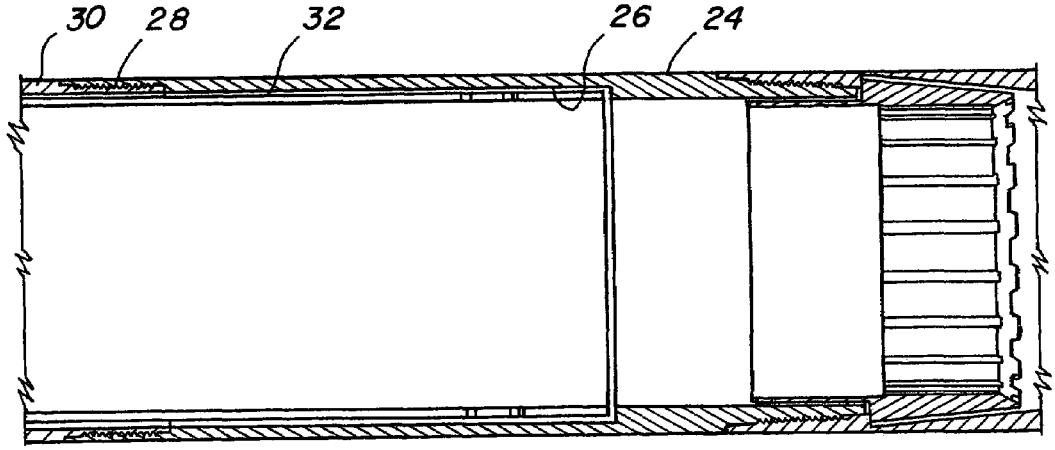
FIG. 5 is a schematic view of a downhole end of the liner with assembled support structures.

In the assembled condition of a coring assembly wherein the liner as disclosed herein is utilized, the assembly is much like that of the prior art except that the shoe on bottom and plug on top end of the liner are slightly modified relative to the prior art. With reference to FIGS. 4 and 5, the distinction between the shoes of the prior art and those employed herein is discussed. The uphole end of the liner is illustrated in FIG. 4 while the downhole end is illustrated in FIG. 5. Referring to FIG. 4, the liner 10 is illustrated being supported at an inside dimension thereof by a pressure relief plug 20. One of ordinary skill in the art will recognize the relief plug because it is almost identical to such plug as was used in the prior art. The only difference in this plug is that the outside dimension thereof is larger than the prior art. It is larger by about a ⅝ inch over the diameter thereof so that a clearance of about 3/32 inch is available between the liner 10 and the plug 20. The clearance is identified at 22. As the balance of the plug is known, no further discussion thereof is necessary.

Referring to FIG. 5, the downhole end of liner 10 is illustrated in assembled form with a coring assembly so that the unique support therefore may be appreciated. One of ordinary skill in the art will recognize the top end of inner barrel shoe 24 as it is similar to the prior art. The distinction between this component and its cousin in the prior art is that top end inner barrel shoe 24 has been bored out to create a liner receiver 26. One of skill in the art will note that top end inner barrel shoes of the art do not receive the liner. Rather, the liner stops at the thread 28 of the inner barrel 30. In this embodiment, and in order to provide additional support for the liner 10 and also an easy way to remove the liner from the coring assembly, the liner 10 is extended in overall length and the receiver 26 provided to receive that extended length. Clearance 32 is about 1/16 inch around the outside dimension of the liner for support and to take into consideration thermal expansion of the components at depth. The extended length of the liner 10 assists in disassembly of the liner from the balance of components of the coring assembly because it allows for the structure of the liner to be grasped by unscrewing the top end inner barrel shoe 24 from the inner barrel 30. Although not specifically shown, one can easily appreciate that unscrewing the identified sections and removing the top end inner barrel shoe will expose the portion of the liner 10 that extends downhole of the inner barrel 30. The liner 10 may then be grasped manually or by a tool to be withdrawn from the remainder of the inner barrel 30.

While preferred embodiments have been shown and described, modifications and substitutions may be made thereto without departing from the spirit and scope of the invention. Accordingly, it is to be understood that the present invention has been described by way of illustrations and not limitation.

What is claimed is:

1. A coring tubular comprising:

a tubular body receptive to a hydrocarbon formation core;

at least one opening hole radially oriented in the tubular body; and a parting line in the tubular body intersecting the at least one opening hole.

2. The coring tubular as claimed in claim 1 wherein the parting line comprises an easily defeatable section of the tubular body.

3. A coring tubular comprising:

a tubular body;

at least one opening hole radially oriented in the tubular body; and a parting line in the tubular body wherein the parting line comprises a series of perforations.

4. The coring tubular as claimed in claim 3 wherein the perforations extend part-way through a material thickness of the tubular body.

5. A coring tubular comprising:

a tubular body;

at least one opening hole radially oriented in the tubular body; and a parting line in the tubular body wherein the parting line comprises a thinner section of the tubular body.

6. The coring tubular as claimed in claim 1 wherein the at least one opening hole is sized to operably receive a pry tool.

7. A coring tubular comprising:

a tubular body;

at least one opening hole radially oriented in the tubular body; and a parting line in the tubular body wherein the parting line further comprises a shear arrangement.

8. The coring tubular as claimed in claim 7 wherein the shear arrangement is a zig zag pattern of the parting line.

9. The coring tubular as claimed in claim 8 wherein the zig zag pattern is at about a 45° angle.

10. The coring tubular as claimed in claim 1 wherein the tubular body is an inner barrel.

11. The coring tubular as claimed in claim 1 wherein the tubular body is an inner barrel liner.

12. A method of reducing contamination of a core sample comprising:

installing a coring tubular as claimed in claim 1;

running the coring tubular to obtain a sample;

withdrawing the coring tubular from a target location; and retrieving the core sample by prying the tubular open at an opening hole along the parting line.

13. A method as claimed in claim 12 wherein said retrieving further comprises unscrewing the core bit to expose an end length of the tubular for withdrawal from the core bit.

14. A method as claimed in claim 12 wherein said tubular is supported externally by a top end inner barrel shoe.

15. A method as claimed in claim 12 wherein said tubular is internally supported by a pressure relief plug.

16. A method as claimed in claim 15 wherein said pressure relief plug includes a clearance of about 3/32 inch between itself and the tubular.

17. A method as claimed in claim 14 wherein said top end inner barrel shoe includes a clearance of about 1/16 inch between itself and the tubular.

* * * * *